US008750550B2

(12) United States Patent
Lee et al.

(10) Patent No.: US 8,750,550 B2
(45) Date of Patent: Jun. 10, 2014

(54) MEMS MICROPHONE

(75) Inventors: Sang Ho Lee, Incheon (KR); Yong Hyun Shim, Incheon (KR)

(73) Assignee: BSE Co., Ltd., Incheon (KR)

( * ) Notice: Subject to any disclaimer, the term of this patent is extended or adjusted under 35 U.S.C. 154(b) by 0 days.

(21) Appl. No.: 13/494,336

(22) Filed: Jun. 12, 2012

(65) Prior Publication Data

US 2013/0136291 A1 May 30, 2013

(30) Foreign Application Priority Data

Nov. 30, 2011 (KR) ..... 10-2011-0127252

(51) Int. Cl.
*H04R 9/08* (2006.01)
*H04R 1/20* (2006.01)

(52) U.S. Cl.
USPC ..... 381/355; 381/351

(58) Field of Classification Search
USPC ..... 381/345, 355, 361, 429, 351
See application file for complete search history.

(56) References Cited

U.S. PATENT DOCUMENTS

2010/0272302 A1* 10/2010 Feiertag et al. ..... 381/361
2012/0008805 A1* 1/2012 Hachinohe et al. ..... 381/163

FOREIGN PATENT DOCUMENTS

KR 1020080005801 A 1/2008
WO WO 2011/132009 * 10/2011 ..... 381/355

* cited by examiner

*Primary Examiner* — Brian Ensey
*Assistant Examiner* — Norman Yu
(74) *Attorney, Agent, or Firm* — Ladas & Parry LLP

(57) ABSTRACT

A MEMS microphone includes a case having sidewalls, a top wall, and an opened bottom; a PCB attached to the bottom of the case; a MEMS chip, which is arranged on the PCB and includes an inner-MEMS space; and at least one sound hole formed through a surface of the case for introduction of external sounds, wherein an internal communicating unit which forms a sound path via which the sound hole and the inside-MEMS space communicate with each other is arranged inside the case such that external sounds introduced via the sound hole pass through the sound path and enter the inner-MEMS space.

16 Claims, 3 Drawing Sheets

MEMS MICROPHONE

CROSS-REFERENCE TO RELATED PATENT APPLICATION

This application claims the benefit of Korean Patent Application No. 10-2011-0127252, filed on Nov. 30, 2011, in the Korean Intellectual Property Office, the disclosure of which is incorporated herein in its entirety by reference.

BACKGROUND OF THE INVENTION

1. Field of the Invention

The present invention relates to a micro electro mechanical system (MEMS) microphone, and more particularly, to a MEMS microphone in which a back chamber space for a MEMS chip may be secured in order to obtain improved sound characteristics.

2. Description of the Related Art

A microphone is necessarily used in a mobile communication terminal. A traditional type condenser microphone includes a pair elements formed of a diaphragm and a back plate for forming a capacitance C that changes in correspondence with sound pressure and a junction field effect transistor (JFET) for buffering output signals.

Such a traditional type condenser microphone is completely formed as a single assembly by inserting a diaphragm, a spacer ring, an insulation ring, a back plate, and an electric current application ring into a single case in the stated order, inserting a PCB, on which circuit devices are mounted, into the case, and bending an end of the case toward the PCB.

Recently, a semiconductor fabrication technique using micromachining methods has been used for improving the integration of fine devices. By using this technique, a so-called micro electro mechanical system (MEMS), μm-sized ultra-small sensors, actuators, and electro-mechanical structures may be fabricated by using micromachining methods, and more particularly, integrated circuit methods, in a semiconductor fabrication process.

In a MEMS chip microphone fabricated by using such micromachining methods, traditional microphone components, such as a diaphragm, a spacer ring, an insulation ring, a back plate, and an electric current application ring may be miniaturized, multi-functionalized, and densely integrated via ultra-high precision fabrication methods for improved stability and reliability.

FIG. 1 is a schematic sectional view of a conventional MEMS microphone 100 having a MEMS chip 120. The MEMS microphone 100 includes a printed circuit board (PCB) 110, the MEMS chip 120 mounted on the PCB 110, an application specific integrated circuit (ASIC) chip 130, which is also referred to as an amplifier, and a case 150 in which sound holes 140 are formed.

In FIG. 1, reference numeral 126 is a space formed inside a MEMS chip. In case of a MEMS microphone in which sound holes are formed in a case as described above, the inner-MEMS space 126 is a back chamber. A back chamber is a space for circulating air generated by oscillation of a diaphragm arranged at the MEMS chip for preventing formation of an acoustic resistance. In other words, the back chamber is a space on the opposite side of a side of a diaphragm where external sound is introduced. When the size of the back chamber increases, sensitivity and single to noise ratio (SNR) of the MEMS microphone increase.

Meanwhile, FIG. 2 shows a MEMS microphone 102 in which sound holes 140 are formed in a PCB 110, not in a case 150. No via hole is formed in the case 150. External sound is introduced via the sound holes 140. In this case, the back chamber is a space 151 inside the case, not a space inside a MEMS chip.

Since the back chamber is the space 151 inside the case 150 in the MEMS microphone 102 shown in FIG. 2, a sufficient space for the back chamber is secured. However, in the case of the MEMS microphone 100 shown in FIG. 1, since the back chamber is the inner-MEMS space 126, a space for the back chamber is too narrow and thus insufficient.

If the size of the back chamber is too narrow as shown in FIG. 1, the sound quality of a MEMS microphone is deteriorated due to a small SNR and poor sensitivity.

PRIOR ART REFERENCE

Patent Reference (Patent Reference 1) Korean Patent Publication No. 2008-0005801

SUMMARY OF THE INVENTION

The present invention provides a micro electro mechanical system (MEMS) microphone in which a sufficient space for a back chamber is secured in order to obtain improved sound characteristics.

According to an aspect of the present invention, there is provided a MEMS microphone including a case having sidewalls, a top wall, and an opened bottom; a PCB attached to the bottom of the case; a MEMS chip, which is arranged on the PCB and includes an inner-MEMS space; and at least one sound hole formed through a surface of the case for introduction of external sounds, wherein an internal communicating unit which forms a sound path via which the sound hole and the inside-MEMS space communicate with each other is arranged inside the case such that external sounds introduced via the sound hole pass through the sound path and enter the inner-MEMS space.

The internal communicating unit may include a first communicating member having a first end attached to the sound hole; and a second communicating member which is arranged below the MEMS chip.

The first communicating member may be formed of an elastic rubber, the second communicating member may be formed of a circuit board material or a metal, and the MEMS chip may be mounted on the second communicating member.

The internal communicating unit may include a first communicating member and an inside-PCB sound path, a sound path communicating with the sound hole may be arranged in the first communicating member, the top end of the first communicating member may be attached to the sound hole, the bottom end of the first communicating member may be attached to a circuit communicating location on the top surface of the PCB, and the inside-PCB sound path may be formed in the PCB such that the inner-MEMS space and the circuit communicating location communicate with each other such that external sounds introduced via the sound hole pass through the sound path of the first communicating member and the inner-PCB sound path of the PCB and enter the inner-MEMS space.

The first communicating member may be formed of an elastic rubber.

The sound hole may be formed in one of the sidewalls.

BRIEF DESCRIPTION OF THE DRAWINGS

The above and other features and advantages of the present invention will become more apparent by describing in detail exemplary embodiments thereof with reference to the attached drawings in which.

DETAILED DESCRIPTION OF THE INVENTION

The present invention will now be described more fully with reference to the accompanying drawings, in which exemplary embodiments of the invention are shown. The invention may, however, be embodied in many different forms and should not be construed as being limited to the embodiments set forth herein.

Figure 1:
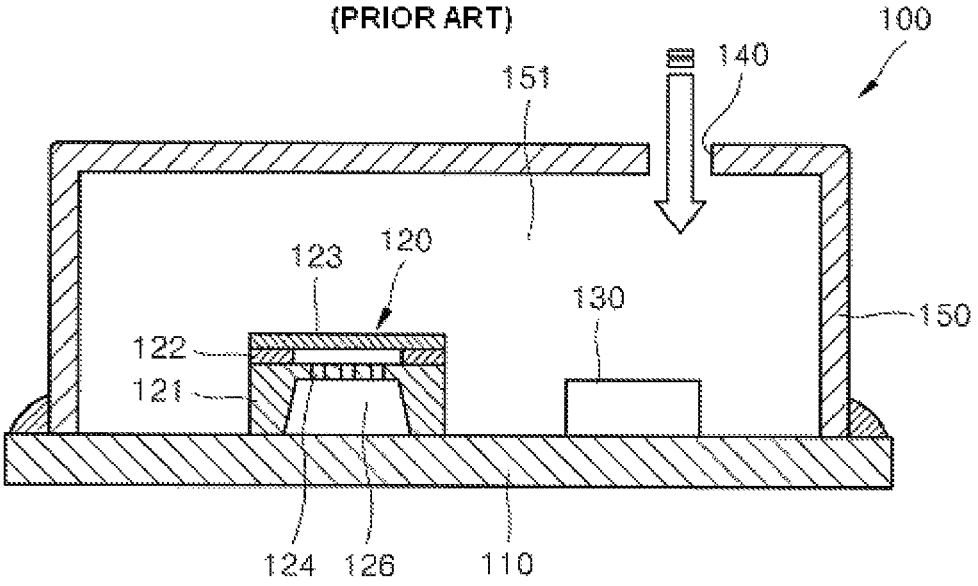
FIG. 1 (PRIOR ART)
FIG. 1 is a schematic sectional view of a conventional micro electro mechanical system (MEMS) microphone.
Figure 2:
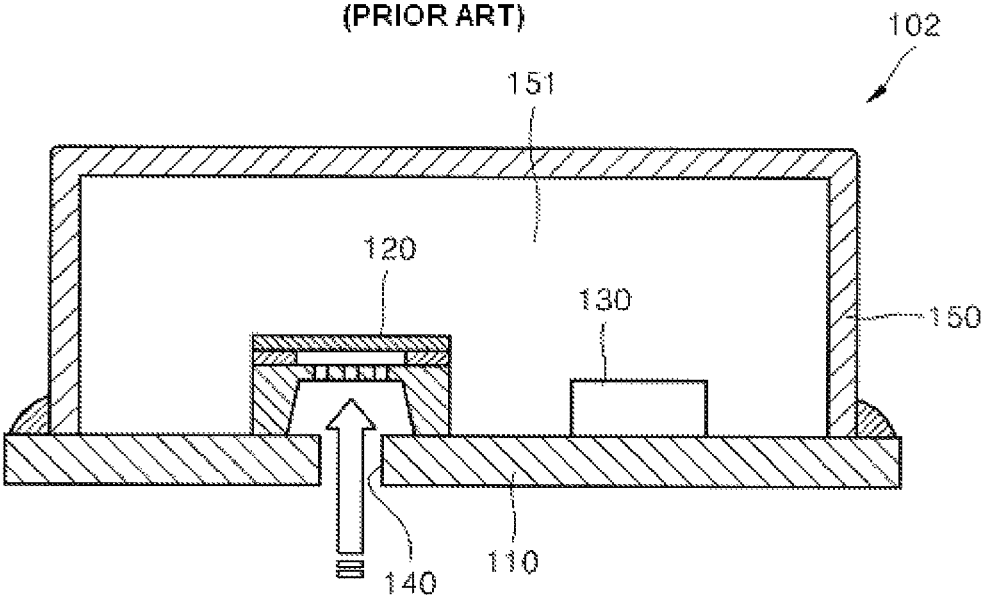
FIG. 2 (PRIOR ART)
FIG. 2 is a schematic sectional view of another conventional MEMS microphone.
Figure 3:
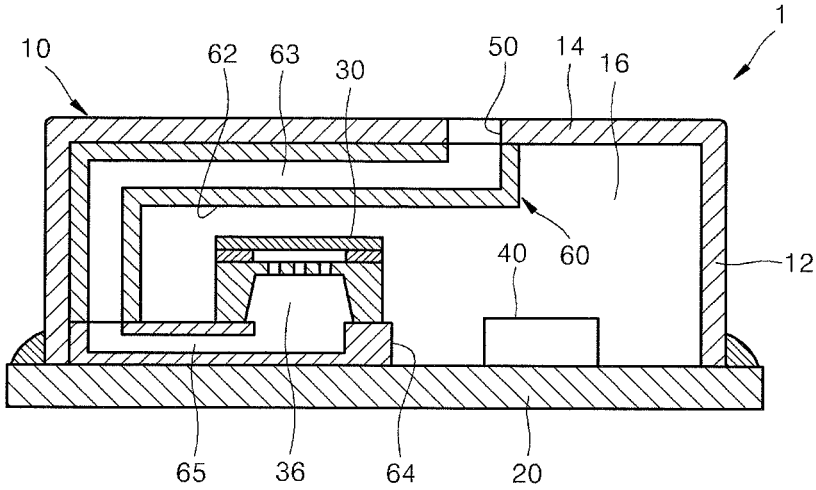
FIG. 3 is a schematic sectional view of a MEMS microphone according to an embodiment of the present invention.

Hereinafter, a micro electro mechanical system (MEMS) microphone will be described with regard to an exemplary embodiment of the invention with reference to FIG. 3.

A MEMS microphone 1 according to the present embodiment is a device for converting sound waves, such as voices and sounds, into electric signals, is generally used in mobile phones, smart phones, and small sound devices, and includes a case 10, a printed circuit board (PCB) 20, a MEMS chip 30, an amplifier 40, sound hole 50, and an internal communicating portion 60.

Particularly, the MEMS microphone 1 according to the present invention is a type of microphone in which a sound hole via which sounds are introduced from the outside is formed in a case and is generally used in mobile communication devices, such as mobile phones and smart phones. However, the applications of the type of MEMS microphone are not limited thereto and the MEMS microphone may be applied to any another small electronic devices employing MEMS microphones.

The case 10 includes sidewalls 12 and a top wall 14. The bottom of the case 10 is opened. In the present embodiment, the bottom of the case 10 is opened, and the case 10 includes the rectangular top wall 14 and the four rectangular sidewalls 12. The bottom of the case 10 is fixed to the PCB 20 via a common method, e.g., soldering or welding.

However, the overall shape of a case may be different in other embodiments of the present invention. In other words, a case may have a cylindrical shape, or shape of the horizontal cross-section of a case may be elliptical or polygonal.

The PCB 20 is attached to the opened bottom of the case 10. After the PCB 20 is attached, the case 10 is sealed except the sound hole 50. Electronic components, such as the MEMS chip 30 and the amplifier 40, are mounted on the PCB 20 directly or indirectly. Since various electronic components are mounted to the PCB 20, the PCB 20 is also referred to as a die PCB.

The MEMS chip 30 is also referred to as a MEMS transducer and is arranged on the PCB 20. Here, the wording 'arranged on' means that the MEMS chip 30 is either directly mounted on the PCB 20 or indirectly mounted on the PCB 20 via other members, such as second communicating units 64 and 64*a*. The MEMS chip 30 is of the same type as MEMS chips used in a type of conventional MEMS microphones in which sound hole is formed in PCBs.

An empty space is formed below the MEMS chip 30, and this space is referred to as an inner-MEMS space 36.

Meanwhile, the component indicated by the reference numeral 40 is an amplifier. The amplifier 40 receives and amplifies electric signals generated by the MEMS chip 30. The amplifier 40 is also referred to as an ASIC chip. Although not shown in detail, the MEMS chip 30 and the amplifier 40 are connected to each other via a wire, such as a gold bonding wire.

The sound hole 50 is formed through the top wall 14 of the case 10. External sounds are introduced into the case 10 via the sound hole 50. Although only one sound hole 50 is described in the present embodiment, two or more sound holes may be formed if required.

The internal communicating portion 60 is arranged in the case 10 and forms sound paths 63 and 65. The sound paths 63 and 65 interconnect the sound hole 50 and the inside-MEMS space 36. Therefore, external sounds introduced via the sound hole 50 pass through the sound paths 63 and 65 formed by the internal communicating portion 60 and enter the inner-MEMS space 36. By forming the sound paths 63 and 65, a space 16 inside the case 10 may be used as the back chamber, instead of the inner-MEMS space 36, and thus, sound quality may be improved.

Meanwhile, in the present embodiment, the internal communicating portion 60 includes a first communicating member 62 and a second communicating member 64.

A first end, which is the top end, of the first communicating member 62 is attached to the sound hole 50. A second end, which is the bottom end, of the first communicating member 62 is attached to the second communicating member 64. The MEMS chip 30 is mounted on the top surface of the second communicating member 64. The MEMS chip 30 is configured to be electrically connected to the PCB 20. Therefore, the second communicating member 64 may be formed of a circuit board material.

Furthermore, according to another embodiment of the present invention, the second communicating member 64 may be formed of a metal. The MEMS chip 30 fixed on the top surface of the second communicating member 64 and the PCB may be electrically connected to each other via separate wires. The second communicating member 64 is located below the MEMS chip 30. Furthermore, the first communicating member 62 is formed of an elastic rubber.

Due to the configuration described above, the MEMS microphone 1 according to the present embodiment has the effects described below.

In the present embodiment, the internal communicating unit 60, which forms the sound paths 63 and 65 for guiding external sounds introduced via the sound hole 50 to the inner-MEMS space 36, is arranged in the case 10.

Therefore, unlike in a conventional case in which sound quality is unsatisfactory due to an insufficient space in a MEMS chip which functions as the back chamber, the entire space 16 in the case becomes the back chamber, and thus, the sound characteristics may be improved.

Since a size of the back chamber is one of the elements directly affecting sound characteristics, a MEMS microphone according to the present embodiment has a significantly larger back chamber than similar types of conventional MEMS microphones, and thus, the sound characteristics may be significantly improved.

Furthermore, in the related art, different types of MEMS chips are used in MEMS microphones in which a sound hole is formed in a PCB and in MEMS microphones in which a sound hole is formed in a case. However, according to the present invention, the same type MEMS chip used in a MEMS microphone in which a sound hole is formed in a PCB may be used. Therefore, it is necessary to prepare only one type MEMS chip, instead of preparing two types of MEMS chips according to types of MEMS microphones.

Furthermore, if the internal communicating portion 60 is divided into the upper portion and the lower portion, that is, the first and second communicating members 62 and 64, the overall assembly of a MEMS microphone is not significantly complicated as compared to those of conventional MEMS microphones. In other words, a MEMS microphone may be easily assembled by attaching the first communicating member 62 to the case 10, mounting the second communicating member 64 on the PCB 20, and attaching the first and second communicating members 62 and 64 to each other. Therefore, an additional assembly may not be necessary or, if necessary, a difficulty related to the additional assembly due to arrangement of the internal communicating unit 60 may be reduced.

Figure 4:
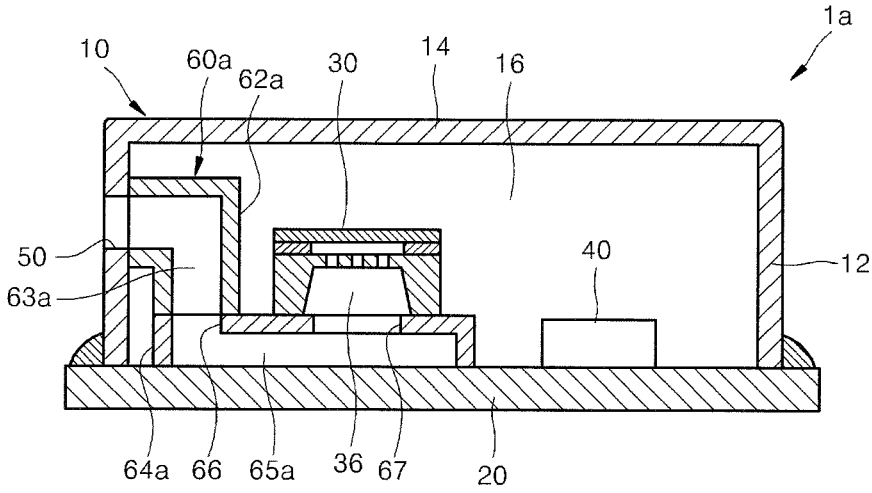
FIG. 4 is a schematic sectional view of a MEMS microphone according to another embodiment of the present invention.

Meanwhile, FIG. 4 shows a MEMS microphone 1*a* according to another embodiment of the present invention. Compared to the embodiment shown in FIG. 3, configurations indicated by reference numerals followed by 'a' perform the same or similar functions as configurations indicated by reference numerals without 'a,' unless described otherwise Compared to the above embodiment, in the MEMS microphone 1*a* according to the present embodiment, the sound hole 50 is formed in the sidewall 12, not in the top wall. The sound hole 50 may be formed at any location and is formed in the sidewall 12 as necessary.

Except the location of the sound hole 50, in the MEMS microphone 1*a* according to the present embodiment, the configuration of an internal communicating unit 60*a* slightly differs from that in the above embodiment.

In the present embodiment, the top end of a first communicating member 62*a* constituting the internal communicating unit 60*a* is attached to the sound hole 50 formed in the sidewall 12. Compared to the second communicating member 64 of FIG. 3, the bottom of a second communicating member 64*a,* which is attached to the first communicating member 62*a,* is opened. However, when the second communicating member 64*a* is firmly mounted on the PCB 20, a sound path 65*a* is formed.

Other configurations except the location of the sound hole 50 and the configuration of the internal communicating unit 60*a* according to the present embodiment are the same as or similar to those in the above embodiment, and thus, detailed descriptions thereof will be omitted.

Compared to the above embodiment, the present embodiment in which the sound hole 50 is formed in the sidewall 12 may have all advantages that may be acquired by arranging an internal communicating unit and may additionally have additional advantages that may be acquired by forming the sound hole 50 in the sidewall 12.

In recently popular electronic devices with small thickness, such as smart phones, sound holes are generally formed in side surfaces. Here, in the MEMS microphone 1*a* according to the present embodiment, the sound hole 50 is formed in the sidewall 12 which faces a sound hole formed in a side surface of an electronic device. Therefore, no space is required for a separate sound path, and thus, space may be utilized more efficiently and the thickness of a smart phone may be further reduced as compared to the related art.

Although an additional height is necessary in the related art in consideration of a sound path, a sound path may be formed without an additional height according to the present embodiment.

Furthermore, in the MEMS microphone 1*a* according to the present embodiment, a sound hole is formed only in a sidewall and not in the top wall, possible damages to internal components due to a vacuum pressure during a surface mount technology (SMT) pickup process for vacuum-absorbing the top wall may be prevented, and possible defects due to introduction of impurities during a cleaning process may be prevented too.

Furthermore, the MEMS microphone 1*a* according to the present embodiment features less tool-interference during the SMT process, and thus, process defects may be prevented.

Figure 5:
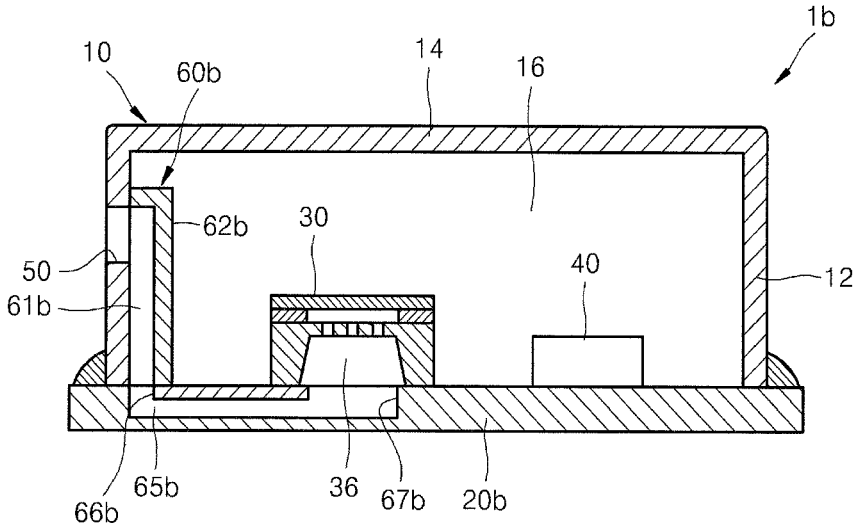
FIG. 5 is a schematic sectional view of a MEMS microphone according to another embodiment of the present invention.

Meanwhile, FIG. 5 shows a MEMS microphone 1*b* according to another embodiment of the present invention. Compared to the embodiment shown in FIG. 3, configurations indicated by reference numerals followed by 'a' perform the same or similar functions as configurations indicated by reference numerals without 'a,' unless described otherwise.

Compared to the embodiment shown in FIG. 4, the MEMS microphone 1*b* according to the present embodiment features the same location of the sound hole 50 and a slightly different configuration of an internal communicating unit 60*b*.

In the present embodiment, the internal communicating unit 60*b* includes a first communicating member 62*b* and an inner-PCB sound path 65*b*. As shown in FIG. 5, a first end of the first communicating unit 62*b* is opened and is attached to the sidewall 12. The top end of the first communicating member 62*b* is connected to the sound hole 50, whereas the bottom end of the first communicating member 62*b* is attached to a circuit communicating location 66*b* on the PCB 20.

A sound path 61*b* communicating with the sound hole 50 is arranged inside the first communicating member 62*b*. The top end of the first communicating member 62*b* is attached to the sound hole 50, whereas the bottom end of the first communicating member 62*b* is attached to the circuit communicating location 66*b* on the PCB 20. The inner-PCB sound path 65*b* is formed in the PCB 20, such that the inner-MEMS space 36 and the circuit communicating location 66*b* communicate with each other.

In the present embodiment, external sounds introduced via the sound hole 50 pass through the inside-PCB sound path 65*b* and enter the inner-MEMS space 36.

Other configurations except the configuration of the internal communicating unit 60*b* according to the present embodiment are the same as or similar to those in the above embodiment, and thus, detailed descriptions thereof will be omitted.

Meanwhile, the configuration of the internal communicating unit 60*b* may be different as long as sounds introduced via a sound hole may be guided to an inner-MEMS space of a MEMS chip.

Since a MEMS microphone according to the present invention includes an internal communicating unit having a sound path via which a sound hole formed in a case and an inside-MEMS space communicate with each other, the size of the back chamber increases, and thus sound characteristics may be improved.

Furthermore, in a MEMS microphone according to the present invention, the same type of MEMS chip (MEMS transducer) applied to a type of MEMS microphone in which a sound hole is formed in a PCB may be used.

What is claimed is:

1. A micro electro mechanical system (MEMS) microphone comprising:

a case having sidewalls, a top wall, and an opened bottom;

a printed circuit board (PCB) attached to the bottom of the case;

a MEMS chip, which is arranged on the PCB and includes an inner-MEMS space; and at least one sound hole formed through a surface of the case for introduction of external sounds, wherein an internal communicating unit which forms a sound path via which the sound hole and the inside- MEMS space communicate with each other is arranged inside the case such that external sounds introduced via the sound hole pass through the sound path and enter the inner-MEMS space, wherein the internal communicating unit comprises:

a first communicating member attached to the sound hole and having a first sound path in communication with the sound hole; and a second communicating member which is attached to an upper surface of the PCB, the second communicating member having a second sound path extending over the PCB so as to be in communication with the first sound path.

2. The MEMS microphone of claim 1, wherein the first communicating member is formed of an elastic rubber, the second communicating member is formed of a circuit board material or a metal, and the MEMS chip is mounted on the second communicating member.

3. The MEMS microphone of claim 1, wherein the first communicating member is formed of an elastic rubber.

4. The MEMS microphone of claim 1, wherein the sound hole is formed in one of the sidewalls.

5. The MEMS microphone of claim 1, wherein the first communicating member and the second communicating member are two distinct and separable components, and the first member is attached to the second member.

6. The MEMS microphone of claim 1, wherein the second communicating member has an opening formed in a top wall of the second communicating member, and the MEMS chip is arranged on the top wall of the second communicating member and over the opening.

7. The MEMS microphone of claim 6, wherein the MEMS chip is electrically connected to the second communicating member.

8. The MEMS microphone of claim 1, wherein the second communicating member has an open bottom, and the bottom of the second communicating member is attached to the PCB such that the second sound path is formed by both the PCB and the second communicating member.

9. A micro electro mechanical system (MEMS) microphone comprising: a case having sidewalls, a top wall, and an opened bottom; a printed circuit board (PCB) attached to the bottom of the case; a MEMS chip, which is arranged on the PCB and includes an inner-MEMS space; and at least one sound hole formed through a surface of the case for introduction of external sounds, wherein an internal communicating unit which forms a sound path via which the sound hole and the inside-MEMS space communicate with each other is arranged inside the case such that external sounds introduced via the sound hole pass through the sound path and enter the inner-MEMS space, wherein the internal communicating unit comprises: a communicating member attached to an inner side surface of the case, the communicating member having a first end attached to the sound hole, wherein the sound path passes through the communicating member, wherein the communicating member is a first communicating member and the MEMS microphone further comprises a second communicating member attached to an upper surface of the PCB, wherein a first sound path of the first communicating member is in communication with a second sound path of the second communicating member.

10. The MEMS microphone of claim 9, wherein the communicating member has an open side, and the open side of the communicating member is attached to an inner side surface of the case such that at least a portion of the sound path is formed by both the case and the communicating member.

11. The MEMS microphone of claim 9, wherein the MEMS chip is electrically connected to the second communicating member.

12. The MEMS microphone of claim 9, wherein the first communicating member and the second communicating member are two distinct and seperable components, and the first member is attached to the second member.

13. The MEMS microphone of claim 9, wherein the first communicating member is formed of an elastic rubber, the second communicating member is formed of a circuit board material or a metal, and the MEMS chip is mounted on the second communicating member.

14. The MEMS microphone of claim 9, wherein the internal communicating unit further comprises an inside-PCB sound path, a sound path communicating with the sound hole is arranged in the communicating member, a first end of the communicating member is attached to the sound hole, a second end of the communicating member is attached to a circuit communicating location on the top surface of the PCB, and the inside-PCB sound path is formed in the PCB such that the inner-MEMS space and the circuit communicating location communicate with each other such that external sounds introduced via the sound hole pass through the sound path of the first communicating member and the inner-PCB sound path of the PCB and enter the inner-MEMS space.

15. The MEMS microphone of claim 9, wherein the first communicating member is formed of an elastic rubber.

16. The MEMS microphone of claim 9, wherein the sound hole is formed in one of the sidewalls.

* * * * *